US006646212B2

(12) United States Patent
Mohtasham

(10) Patent No.: US 6,646,212 B2
(45) Date of Patent: Nov. 11, 2003

(54) SWITCH OPERATING MECHANISM

(75) Inventor: Mehdi Mohtasham, Astley (GB)

(73) Assignee: EJA, Ltd., Buckinghamshire (GB)

( * ) Notice: Subject to any disclaimer, the term of this patent is extended or adjusted under 35 U.S.C. 154(b) by 0 days.

(21) Appl. No.: 10/137,905

(22) Filed: May 1, 2002

(65) Prior Publication Data

US 2002/0175058 A1 Nov. 28, 2002

(30) Foreign Application Priority Data

May 1, 2001 (GB) ..... 0110712

(51) Int. Cl.[7] ..... H01H 3/42; H01H 27/00

(52) U.S. Cl. ..... 200/61.18; 200/17 R; 200/43.07; 200/573

(58) Field of Search ..... 200/17 R, 18, 200/43.01–43.22, 61.62, 61.13, 61.18, 518, 537, 543–546, 573, 574

(56) References Cited

U.S. PATENT DOCUMENTS

| | | | | |
|---|---|---|---|---|
| 4,458,122 A | * | 7/1984 | Knight | 200/518 |
| 4,658,102 A | * | 4/1987 | Seim et al. | 200/17 R |
| 5,665,947 A | * | 9/1997 | Falcon | 200/61.18 |
| 6,365,850 B1 | * | 4/2002 | Arnold et al. | 200/17 R |

FOREIGN PATENT DOCUMENTS

| | | |
|---|---|---|
| EP | 0864169 | 6/1997 |
| FR | 2501411 | 9/1982 |
| GB | 1473497 | 5/1977 |

* cited by examiner

*Primary Examiner*—J. R. Scott
(74) *Attorney, Agent, or Firm*—Quarles & Brady LLP; Alexander M. Gerasimow; William R. Walbrun

(57) ABSTRACT

A switch mechanism comprising a housing in which a switch is mounted, the switch being actuable to switch between first and second conditions. A cam is mounted within the housing to rotate about a predetermined cam axis, the cam defining a cam surface against which a cam follower bears such that rotation of the cam causes displacement of the cam follower to activate the switch. An actuator shaft which may be connected to a safety rope is mounted to be axially displaceable within the housing, the actuator shaft being mechanically coupled to the cam such that axial displacement of the shaft causes the cam to rotate about its axis. The actuator shaft is positionable in an intermediate axial position in which the cam is rotatable to a predetermined rotational position such that the cam follower causes the switch to assume the first condition. Displacement of the actuator shaft from the intermediate position when the cam is in the predetermined position rotates the cam such that the cam follower causes the switch to assume the second position. The cam axis is transversed to the displacement direction of the actuator shaft. The actuator shaft defines first and second abutment surfaces, the first abutment surface bearing against and causing rotation of the cam when the actuator shaft is displaced from the intermediate position in one direction, and the second abutment surface bearing against and causing rotation of the cam when the actuator is displaced from the intermediate position in the other direction.

12 Claims, 8 Drawing Sheets

SWITCH OPERATING MECHANISM

CROSS-REFERENCE TO RELATED APPLICATIONS

The present application claims priority to United Kingdom patent application number 0110712.7, entitled "Switch Mechanism" and filed on May 1, 2001.

STATEMENT REGARDING FEDERALLY SPONSORED RESEARCH OR DEVELOPMENT

BACKGROUND OF THE INVENTION

The present invention relates to a switch mechanism and more particularly, but not exclusively, to a switch mechanism which can be operated by a rope to control the supply of power to for example kinetic machinery.

Known rope operated switch mechanisms comprise a safety switch adapted to be fitted in proximity to a machine and an actuator connected to the switch an operable by a rope to turn off the electrical power supply when the rope is pulled or slackened. Safety switches of this type have a housing in which a switch is mounted, the switch being actuable to switch between first and second conditions, the first condition corresponding for example to a pair on condition and the second condition corresponding to a pair off condition. A cam is mounted within the housing, the cam defining a cam surface against which a cam follower bears. Displacement of the cam causes displacement of the cam follower to actuate the switch.

In one known switch described in U.S. Pat. No. 5,665,947, the cam is defined by a side surface of an axially displaceable shaft. The cam follower is in the form of a ball which is biased against the side of the shaft and a switch operating member which is pushed outwards relative to the housing so as to protrude into contact with the switch. The arrangement is such that a mechanical snap action mechanism is achieved which locks the cam structure in position so as to maintain the switch operator in an extending position after axial displacement of the shaft either as the result of the pulling of the shaft outwards relative to the housing as a result of tension being applied to a cable connected to the shaft or as a result of that cable being severed. Thus the shaft is displaceable from an intermediate position in which the switch assumes one of the first and second conditions and positions displaced in either direction relative to that intermediate position in which the switch is in the other of the two conditions.

The arrangement described in U.S. Pat. No. 5,665,947 works satisfactorily but the overall size of the mechanism is relatively large given that components displaced as a result of axial movement of the shaft are located to the side of that shaft. Furthermore, although the described mechanism is claimed to provide a snap action, great care must be taken in setting up the various components so that the system always operates reliably. It is of course important that if the shaft is displaced to a position in which an associated machine is disabled by for example pulling gently on the rope release of the rope does not result in the shaft returning to a position in which the machine is re-energized.

International Patent Application No. WO97/20334 describes a switch mechanism in which axial displacements of the shaft connected to the rope are used to displace a pivotal lever relative to a cam surface defined by the switching mechanism housing. This effectively amplifies the magnitude of axial displacements of the shaft so as to make it easier to arrange an over centre mechanism to rapidly rotate the cam as soon as a relatively small displacement of the shaft has occurred. The positioning of a pivotally mounted lever and a cam surface to one side of the actuator shaft does however require a relatively large housing to accommodate all of the components.

BRIEF SUMMARY OF THE INVENTION

In one aspect the present invention provides a switch mechanism which can be used in association with a rope switch arrangement and which is both compact and reliable.

According to the present invention there is provided a switch mechanism comprising a housing, a switch mounted within the housing, the switch being actuable to switch between first and second conditions, a cam mounted within the housing to rotate about a predetermined cam axis, the cam defining a cam surface, a cam follower mounted within the housing, the cam follower bearing against the cam surface such that rotation of the cam causes displacement of the cam follower to activate the switch, and an actuator shaft mounted to be axially displaceable within the housing, the actuator shaft being mechanically coupled to the cam such that axial displacement of the shaft causes the cam to rotate about its axis, wherein the actuator shaft is positionable in an intermediate axial position in which the cam is rotatable to a predetermined rotational position such that the cam follower causes the switch to assume the first condition, displacement of the actuator shaft from the intermediate position when the cam is in the predetermined position rotates the cam such that the cam follower causes the switch to assume the second position, the cam axis is transverse to the displacement direction of the actuator shaft, and the actuator shaft defines first and second abutment surfaces, the first abutment surface bearing against and causing rotation of the cam when the actuator shaft is displaced from the intermediate position in one direction, and the second abutment surface bearing against and causing rotation of the cam when the actuator is displaced from the intermediate position in the other direction.

An end of the actuator shaft adjacent the cam may define first and second arms which extend on opposite sides of the cam, the first arm defining the first abutment surface and the second arm defining the second abutment surface. Each arm may define further abutment surfaces, the further abutment surfaces obstructing rotation of the cam to the predetermined rotational position unless the actuator shaft is in the intermediate position. The arms may be defined by a fork member which is separable from but axially locked to a shaft member. The cam rotation axis is preferably aligned with an axis along which an actuator shaft is displaceable. Thus a very compact overall mechanism can be provided with all the active components in line.

A snap-action operation may be achieved by providing a member which is biased against the cam in a direction transverse to the cam axis, and arranging that the member bears against the side of the cam shaped such that when the cam is in the predetermined rotational position the biasing direction is aligned with the cam axis, and such that after rotation of the cam away from the predetermined rotational position the member applies a torque to the cam in a direction to increase that direction.

Given that the cam axis is transverse to the actuator shaft axis, one end of the cam may extend outside the housing to enable that end to be gripped to apply torque manually to rotate the cam.

The housing may comprise three sections, each section receiving a respective one of the actuator shaft, the cam and the switch. The actuator shaft extends into the section receiving the cam and the cam follower extends from the switch into the section receiving the cam.

This and other aspects of the invention are not intended to define the scope of the invention for which purpose claims are provided. In the following description, reference is made to the accompanying drawings which form a part hereof, and which there is shown by way of illustration, and not limitation, preferred embodiments of the invention. Such embodiments do not define the scope of the invention and reference must therefore be made to the claims for this purpose.

BRIEF DESCRIPTION OF THE DRAWINGS

An embodiment of the present invention will now be described, by way of example, with reference to the accompanying drawings, in which.

DETAILED DESCRIPTION OF THE PREFERRED EMBODIMENT

Figure 1:
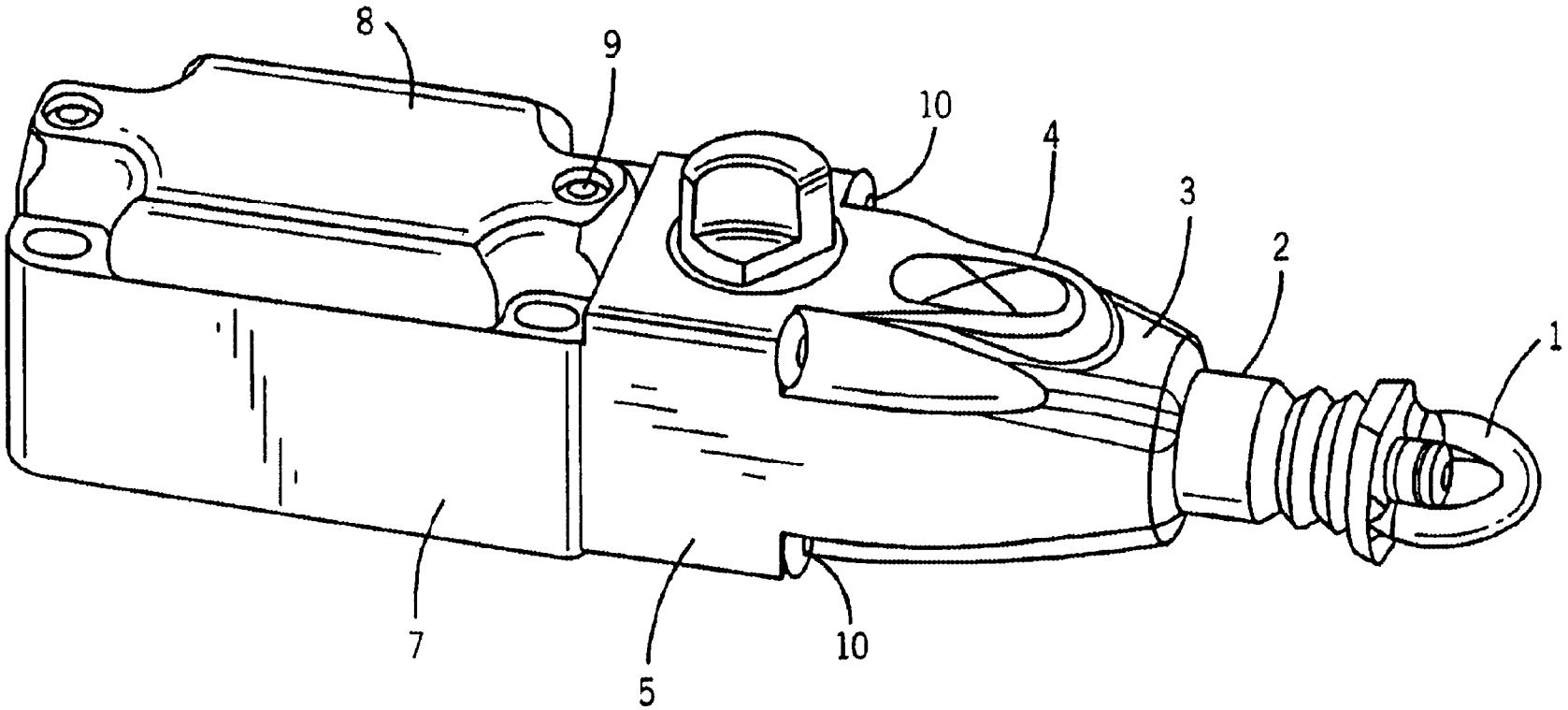
FIG. 1 is a perspective view of a rope switch assembly in accordance with the invention.

Referring to FIG. 1, the assembly comprises a metallic eye 1 for attachment to a rope (not shown). Eye 1 is attached to a shaft (not shown in the view of FIG. 1) which passes through a resilient boot 2 into a first housing section 3. Housing 3 defines a window provided with a transparent cover 4 to allow the observation of the movement of components within the housing 3 through that window. A second housing section 5 receives an actuator camshaft (not shown in the view of FIG. 1) which is engaged by a reset knob 6 extending outside the housing 5. Housings 3 and 5 are connected to a third housing section 7 which in use houses a switch assembly of known type (not shown in the view of FIG. 1). Switch housing 7 has a lid 8 which is secured in position by bolts 9. The housings 3, 5 and 7 are secured together by bolts 10.

Figure 2:
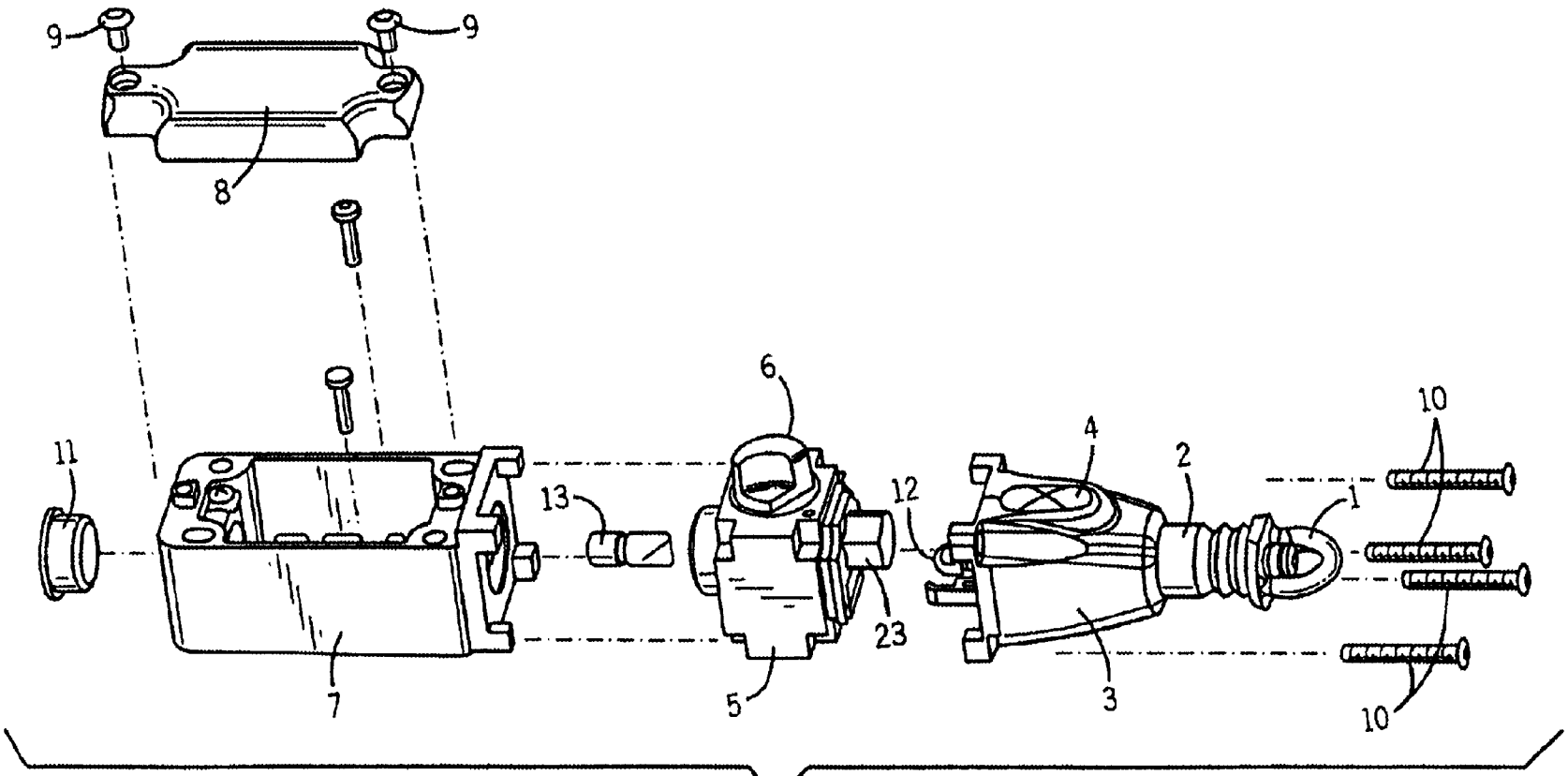
FIG. 2 is an exploded view of components of the assembly of FIG. 1.

Referring to FIG. 2, a resilient plug 11 is provided to block a cable entry port in the switch housing 7. In use cables are pushed through apertures cut in the plug 11 and connected to a switch assembly (not shown in FIG. 2) located within the switch housing 7. A fork 12 which is axially displaceable with the eye 1 extends from the spring housing 3 to engage in the actuator housing 5. A cam follower plunger 13 is positioned between the actuator housing 5 and the switch housing 7 to transmit axial motion between the actuator housing 5 and the switch assembly which in use is mounted within the switch housing 7.

Figure 3:
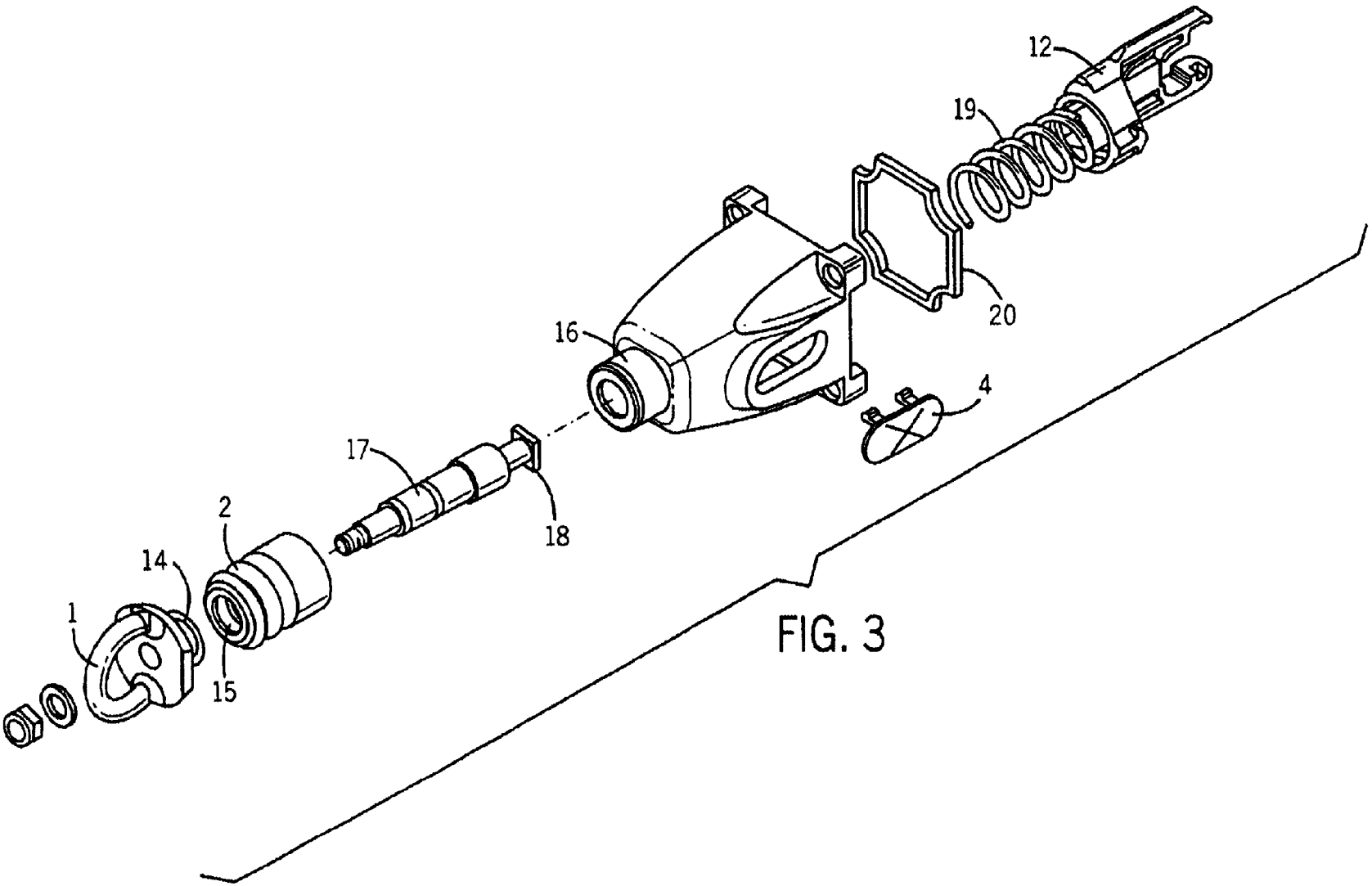
FIG. 3 is a further exploded view of components of the assembly of FIG. 1.

Referring to FIG. 3, this shows in greater detail the structure of the spring housing 3. The eye 1 defines a groove 14 in which a radially extending lip 15 defined by one end of the resilient boot 2 engages to form a seal. The other end of the boot 2 is generally cylindrical and in use engages over a cylindrical extension 16 defined by the spring housing 3. The eye 1 is connected by a nut and washer to a threaded end of a shaft 17, the other end of the shaft 17 defining a square flange 18. The shaft 17 and fork 12 together define a cam actuator shaft. As described in greater detail below, the flange 18 is engaged in the fork 12 such that the two components are axially locked together, a compression spring 19 being arranged around the shaft 17 and between the housing 3 and the fork 12 such that the eye 1 is biased by the spring towards the housing 3. A gasket 20 is provided to seal the joint between the spring housing 3 and the actuator housing 5.

Figure 4:
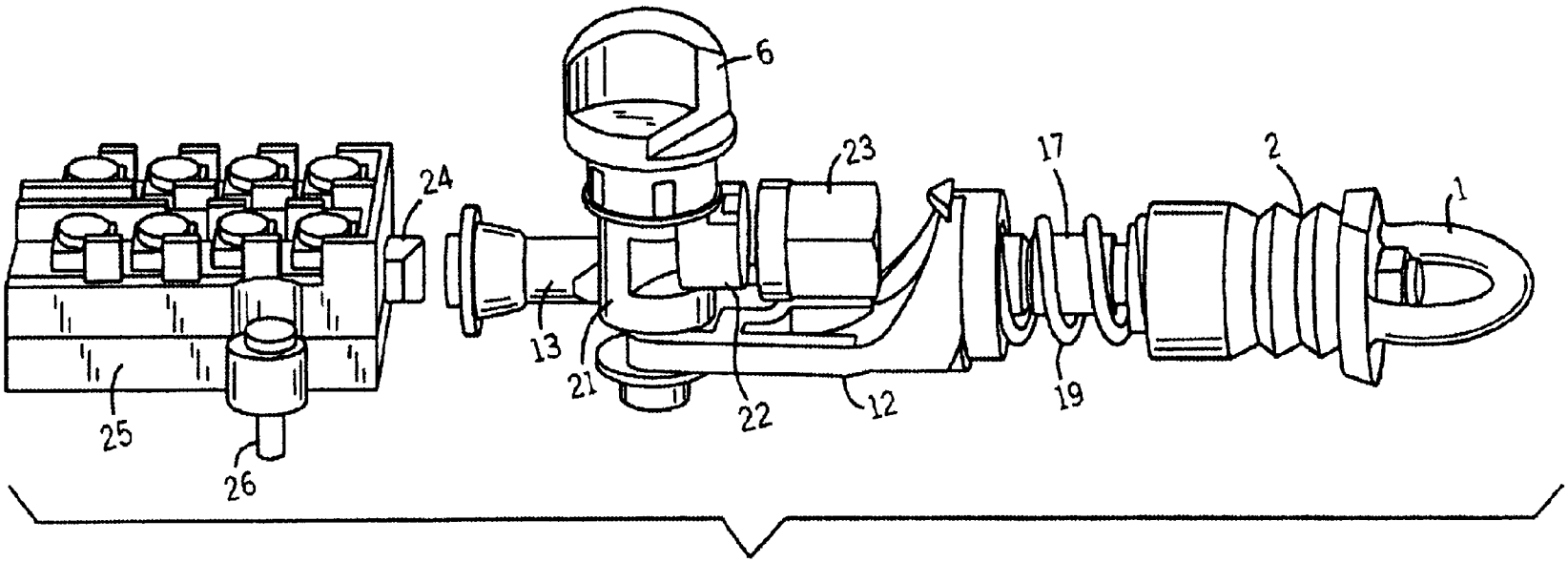
FIG. 4 is a perspective view of internal components of the assembly of FIG. 1.

Referring to FIG. 4, this illustrates the components received within the three housing sections 3, 5 and 7. The reset knob 6 is engaged on one end of a camshaft 21 against which the plunger 13 bears. The camshaft 21 is located between two fingers defined by the fork 12, and is acted upon by a first member 22 which is biased against the camshaft 21 by a compression spring located between the first member 22 and a second member 23. The member 23 is retained in engagement with the actuator housing 5 (FIG. 2) as described in greater detail below. The plunger 13 is located adjacent an actuating plunger 24 of a switch assembly 25 which in use is secured within the switch housing 7 (FIG. 2) by bolts 26.

In the position of the components as shown in FIG. 4, the plunger 13 is retracted from contact with the plunger 24. If however the fork 12 is moved in either axial direction as a result of displacement of the eye 1 the camshaft 21 will be rotated from the position shown, displacing the plunger 13 into contact with the plunger 24 and thereby causing contacts mounted within the switch assembly 25 to switch. The detailed interaction of the components which causes such rotation of the camshaft 21 will now be described with reference to FIGS. 5 to 12.

Figure 5:
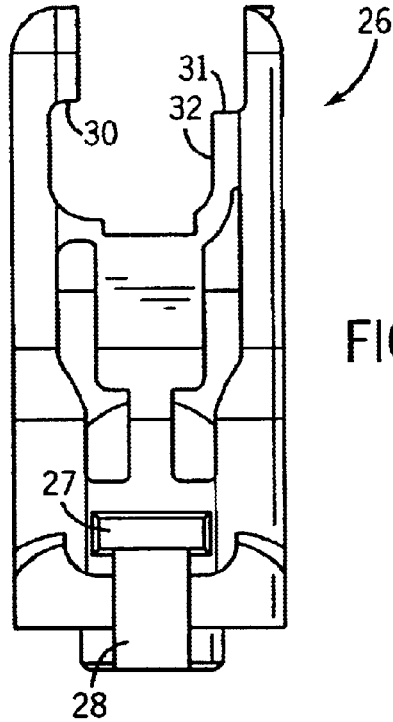
FIG. 5 is a view from below of an actuator fork shown in FIG. 4.
Figure 7:
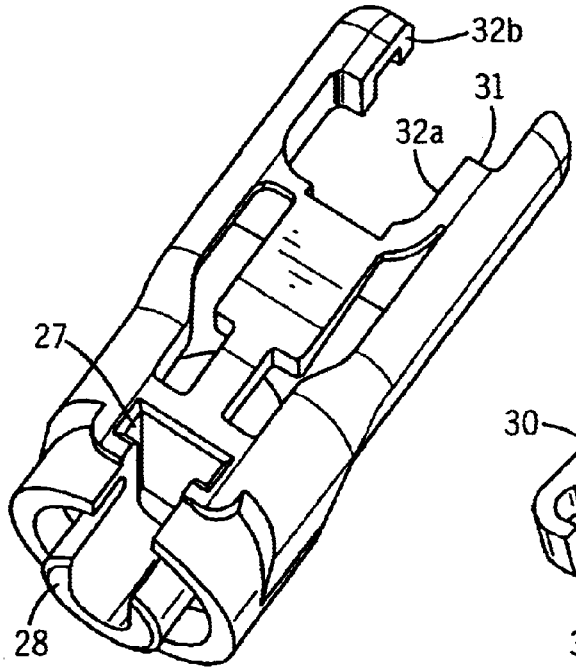
FIG. 7 is a perspective view of the actuator fork of FIG. 5 as seen from below.
Figure 6:
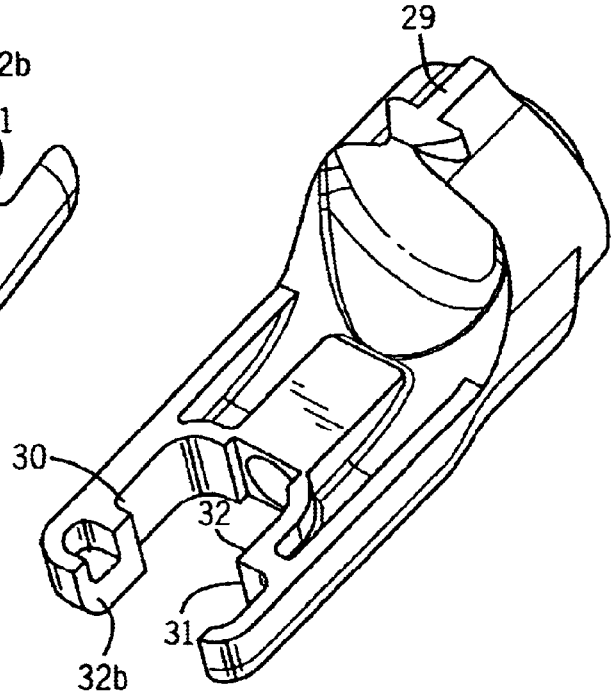
FIG. 6 is a perspective view of the actuator fork of FIG. 5 as seen from above.
Figure 8:
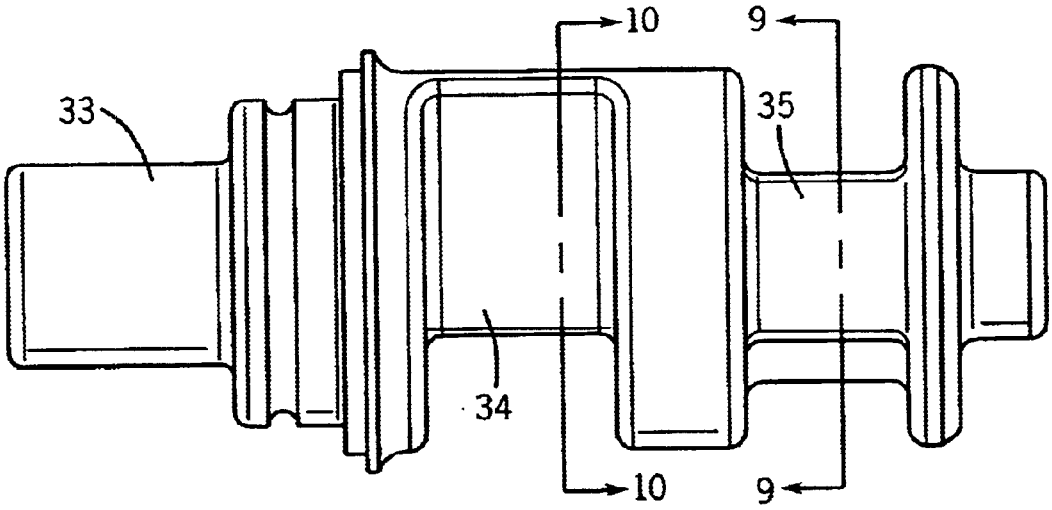
FIG. 8 is a view of a rotatable camshaft shown in FIG. 4.

Referring to FIGS. 5, 6 and 7, the detailed structure of the fork 12 is illustrated. One end of the fork defines a rectangular slot 27 into which the square flange 18 mounted on the end of the shaft 17 can be slipped so that the shaft 17 is received within an open sided bore 28. Thus by appropriate manipulation of the shaft 17 relative to the fork 12 those two components can be inter-engaged so as to move in the axial direction as a single body. As shown in FIG. 6, on the side of the fork remote from the slot 27 an arrowhead shaped projection 29 is defined, that projection being positioned so as be visible beneath the window 4 (see FIG. 1). Thus the axial position of the fork relative to the spring housing 3 can be accurately visually assessed simply by looking through the window 4.

The other end of the fork supports two arms defining abutment surfaces 30, 31, 32*a* and 32*b* which are significant to the control of the rotation of the camshaft. The first abutment surface 30 acts to apply a force to the camshaft when the shaft 17 (FIG. 4) is moved to the right in FIG. 4, the second abutment surface 31 applies a force to the camshaft when the shaft 17 moves to the left in FIG. 1, and the further abutment surface 32*a* obstructs rotation of the camshaft in the event that the camshaft has been displaced as the result of shaft 17 being moved to the left in FIG. 4 and not pulled back, for example by tightening a rope attached to the eye 1. The further abutment surface 32*b* serves a similar purpose when the shaft 17 has been displaced in the opposite direction.

Referring to FIGS. 8, 9, 10 and 11, the detailed structure of the camshaft 21 will now be described. The camshaft 21 is in three sections, that is a head 33 onto which the reset knob 6 (FIGS. 1, 4 and 11) is engaged, a central section defining an edge 34 facing the spring biased member 22 (FIG. 4), and a base section defining a central hub 35.

Figure 9:
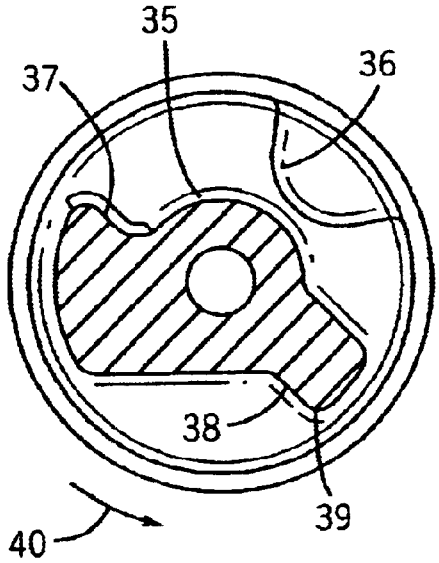
FIG. 9 is a section on line 9—9 of FIG. 8.

FIG. 9 is a section through the base section showing a recess 36 which in the orientation shown in FIG. 4 is aligned to receive the end of the plunger 13. Projecting from the hub 35 are two cams defining surfaces 37 and 38. In the orientation of the camshaft 21 shown in FIG. 4, the surface 37 faces the surface 30 defined by the fork, and the surface 38 faces the surface 30 defined by the fork. As is most readily seen from FIG. 5, the surfaces 30 and 31 are offset in the axial direction such that an axial displacement of the fork can to a small extent be accommodated without any force being applied to the camshaft 21. The surface 38 extends from a corner 39, that corner being intended to pass along the surface 32*a* of the fork if the surface 30 on the fork pushes the camshaft 21 so as to cause it to rotate in the direction of arrow 40 in FIG. 9.

Figure 10:
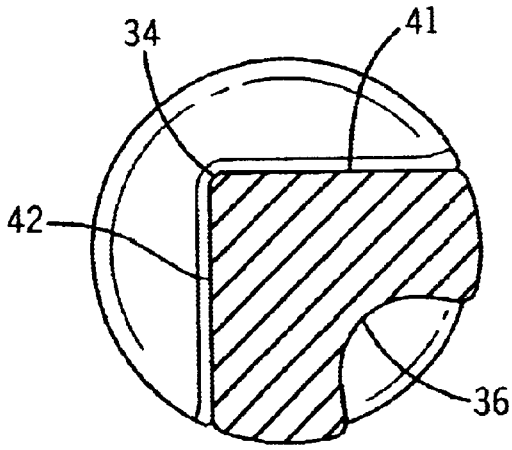
FIG. 10 is a section on line 10—10 of FIG. 8.
Figure 11:
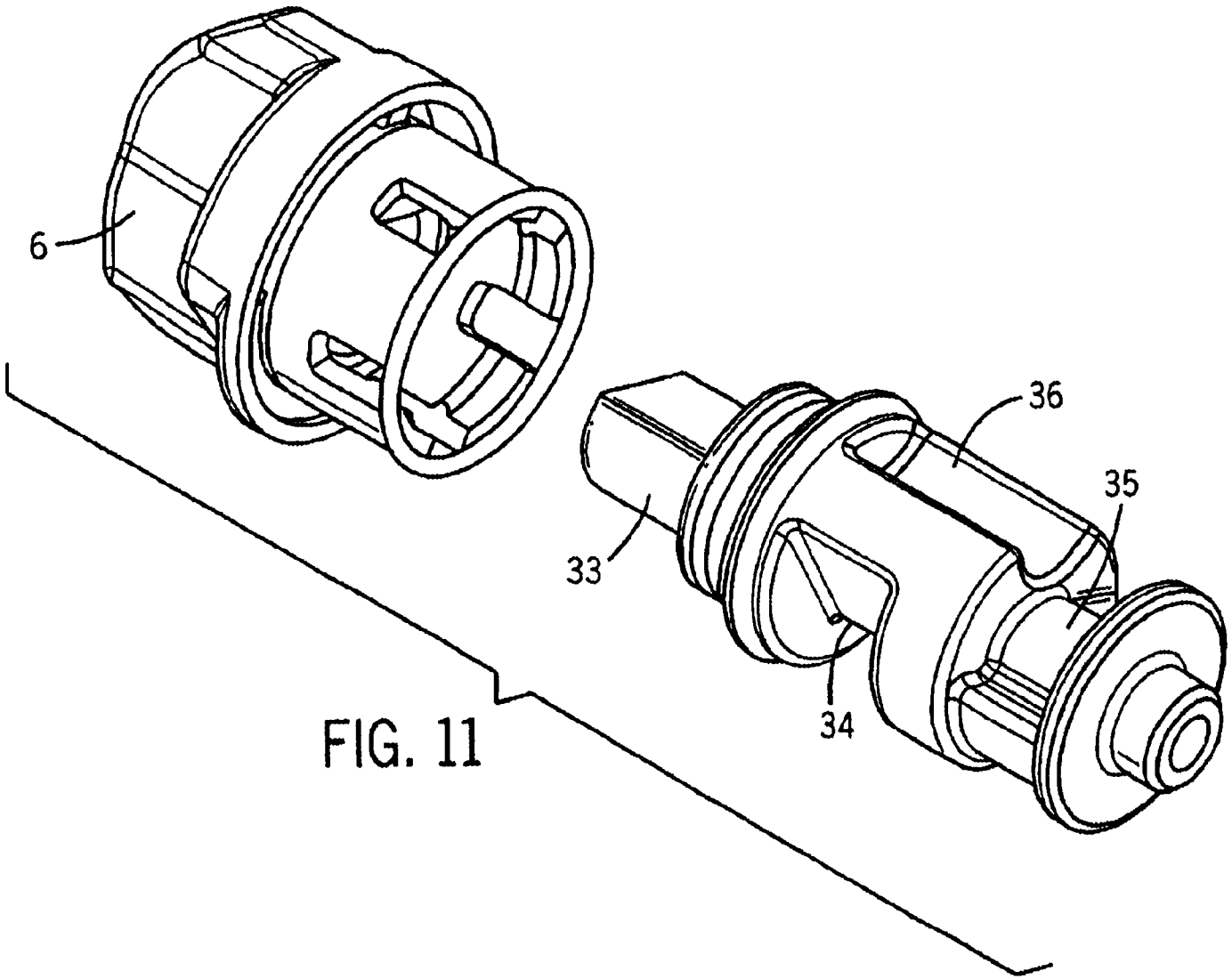
FIG. 11 is an exploded view showing the camshaft of FIG. 8 and a reset knob which in use engages the camshaft.

Referring to FIG. 10, this shows the edge 34 on the central section of the camshaft and the recess 36 which receives the switch actuating plunger 13 (FIG. 4). In the orientation of the camshaft shown in FIG. 4, two flat surfaces 41 and 42 extending at right angles from the edge 34 are each inclined at 45° to the axis of the shaft 17. Pressure is applied to the edge 34 by the spring biased member 22 but no significant torque is applied as the spring force is directed through the axis of rotation of the camshaft 21. If however the camshaft 21 is rotated from the position shown in FIG. 4 the camshaft 21 will be driven in rotation as a result of the spring force (which is applied through the edge 34) no longer being directed through the camshaft rotation axis. The camshaft 21 will as a result snap into a position in which one of the surfaces 41 and 42 lies flat against the member 21. In such an orientation the switch actuating plunger 13 will no longer be received within the recess 36, and as a result the plunger 13 will be axially displaced against the plunger 24 of the switch assembly 25 (FIG. 4).

Figure 12:
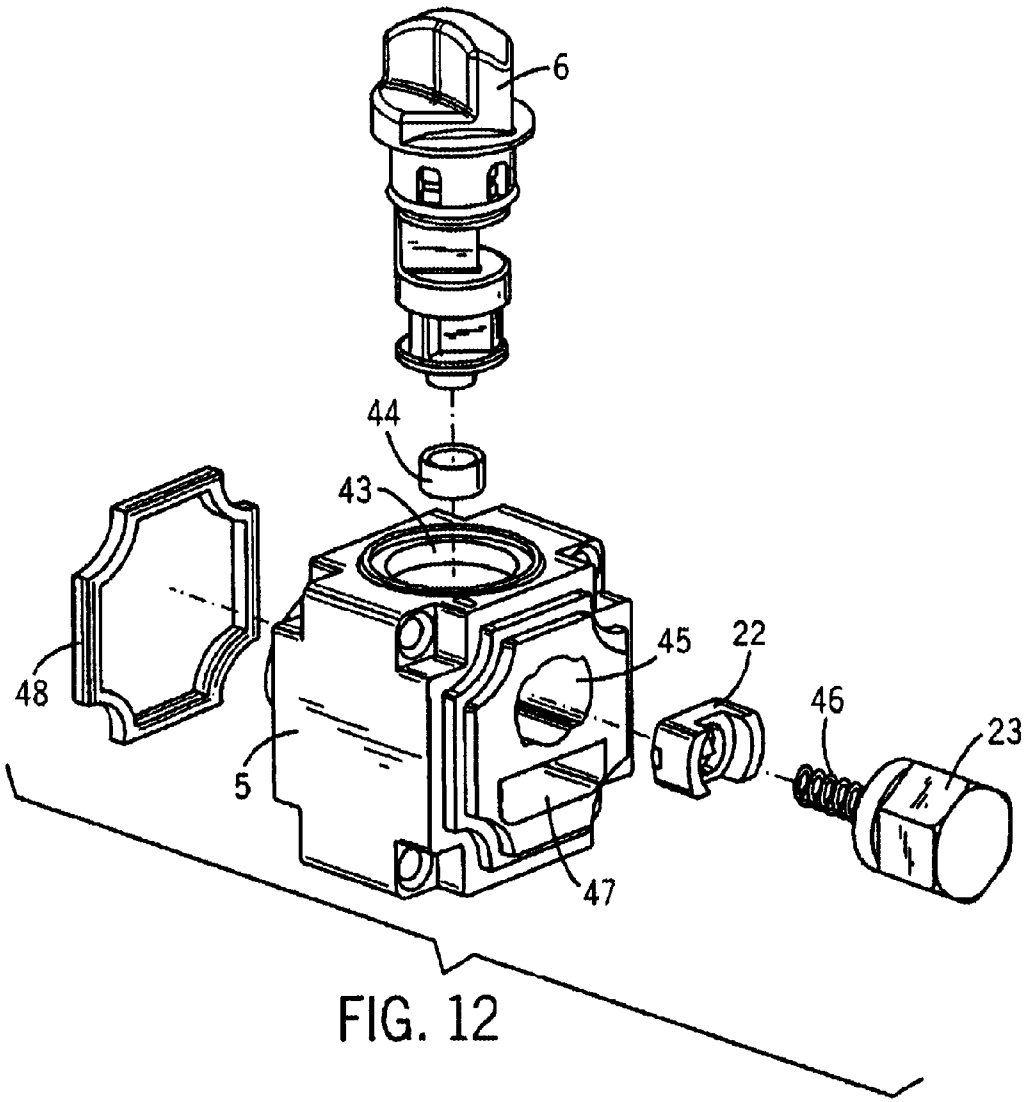
FIG. 12 is an exploded view of the camshaft of FIG. 8 and its housing and associated components.

Referring to FIG. 12, this shows the camshaft assembly in greater detail. The camshaft 21 is inserted into a first bore 43 defined by the actuator housing 5. A bush 44 provides a secure support for the base of the camshaft and the reset knob 6 is received in a recessed edge formed around the opening of the bore 43. A second bore 45 receives the member 22 which is slidable against the central section of the camshaft under the action of a compression spring 46. An end portion of the member 23 is threaded (not shown) so that it can be screwed into a threaded (not shown) section of the bore 45 to maintain an appropriate degree of compression on the spring 46. A third bore 47 receives the arms defined by the fork 12 (FIGS. 5 to 7) to enable the surfaces 30 and 31 defined by the fork to be positioned facing the surfaces 37 and 38 of the camshaft 21. On assembly, it is necessary to position the camshaft 21 so that the limb of the fork defining surface 30 can be pushed around the side of the cam from which the surface 37 extends. With the fork so inserted it will not be possible then to turn the reset button back to the position shown in FIG. 4 as the surface 32*a* defined by the fork will present an obstruction to the corner 39 of the camshaft. Only after the fork has been pulled back can the reset button 6 be rotated to the position shown in FIG. 4.

As shown in FIG. 12, a gasket 48 is provided to form a seal between the actuator housing 5 and the switch housing 7. When the three housing sections are connected together the overall assembly can be mounted on a support surface and the eye 1 can be connected to a rope. When the rope is slack, the eye 1 will be displaced towards the spring housing 3, causing the surface 31 of the fork to push against the surface 38 of the camshaft 21. This in turn causes the camshaft 21 to rotate in the direction away from the surface 31. This forces the plunger 13 away from the axis of the camshaft 21, actuating the switch assembly and disabling associated equipment. If an attempt is then made to turn the reset knob 6 to the position shown in FIG. 4 without first withdrawing the fork 12, the cam corner 39 is pressed against the surface 32 and further rotation of the recess knob is prevented. If however tension is then applied to the rope so as to pull the fork back to the point at which the surface 32 is pulled clear of the cam corner 39, the reset knob can then be rotated. If thereafter the rope tension is increased further, the surface 30 of the fork will be brought to bear against the surface 37 of the camshaft 21, again causing the camshaft to rotate away from the position shown in FIG. 4. Once again the plunger 13 is displaced out of the recess 36, thereby disabling associated equipment.

The invention has been described in connection with what are presently considered to be the most practical and preferred embodiments. However, the present invention has been presented by way of illustration and is not intended to be limited to the disclosed embodiments. Accordingly, those skilled in the art will realize that the invention is intended to encompass all modifications and alternative arrangement included within the spirit and scope of the invention, as set forth by the appended claims.

I claim:

1. A switch mechanism comprising:

an axially extending housing;

a switch mounted within the housing, the switch being actuable to switch between first and second conditions;

a cam mounted within the housing to rotate about a cam axis, the cam defining a cam surface;

an actuator shaft mounted within the housing and having a shaft end in mechanical communication with the cam, wherein the shaft translates axially to rotate the cam about the cam axis; and a cam follower mounted within the housing and in mechanical communication with the cam surface such that rotation of the cam causes displacement of the cam follower, wherein the cam follower is in mechanical communication with the switch such that displacement of the cam follower selectively causes the switch to assume a predetermined condition.

2. The switch mechanism as recited in claim 1, wherein the actuator shaft is positionable in an intermediate axial position whereby the cam is rotatable to a predetermined rotational position such that the cam follower causes the switch to assume a predetermined first condition.

3. The switch mechanism as recited in claim 2, wherein displacement of the actuator shaft from the intermediate position when the cam is in the predetermined position rotates the cam such that the cam follower causes the switch to assume a second predetermined position.

4. The switch mechanism as recited in claim 3, wherein the actuator shaft defines first and second abutment surfaces, wherein the first abutment surface bears against and causes rotation of the cam when the actuator shaft is displaced from the intermediate position in one direction, and wherein the second abutment surface bears against and causes rotation of the cam when the actuator is displaced from the intermediate position in the other direction.

5. The switch mechanism according to claim 1, wherein an end of the actuator shaft adjacent the cam defines first and second arms which extend on opposite sides of the cam, the first arm defining the first abutment surface and the second arm defining the second abutment surface.

6. The switch mechanism as recited in claim 5, wherein each arm defines a further abutment surface, the further abutment surfaces obstructing rotation of the cam to the predetermined rotational position unless the actuator shaft is in the intermediate position.

7. The switch mechanism as recited in claim 1, wherein the cam axis extends perpendicular to the axial direction.

8. The switch mechanism as recited in claim 1, wherein the shaft end defines a fork member that is separable from but axially locked to a shaft member.

9. The switch mechanism as recited in claim 1 wherein the cam axis is aligned with an axis along which the actuator shaft translates.

10. The switch mechanism as recited in claim 2, further comprising a member which is biased against the cam in a direction transverse to the cam axis, the member bearing against the side of the cam shaped such that when the cam is in the predetermined rotational position the biasing direction is aligned with the cam axis, and such that after rotation of the cam away from the predetermined rotational position the member applies a torque to the cam in a direction to increase that rotation.

11. The switch mechanism as recited in claim 10, wherein one end of the cam extends outside the housing to enable the torque to be applied manually to the cam.

12. The switch mechanism as recited in claim 1, wherein the housing comprises a first section that receives the actuator shaft, a second section that receives the cam, and a third section that receives the switch, wherein the actuator shaft extends into the second section, and wherein the cam follower extends from the switch into the second section.

* * * * *